US006133221A

United States Patent [19]

Beaver et al.

[11] Patent Number: 6,133,221

[45] **Date of Patent: *Oct. 17, 2000**

[54] FLUORINATED HYDROBROMOCARBON SOLVENT CLEANING PROCESS AND COMPOSITION

[75] Inventors: Phillip R. Beaver; James E. Boone; Dixie E. Goins; Eric W. Liimatta; David L. Shelton; Ronald L. Shubkin, all of Baton Rouge, La.

[73] Assignee: Albemarle Corporation, Richmond, Va.

[ * ] Notice: This patent is subject to a terminal disclaimer.

[21] Appl. No.: 09/229,779

[22] Filed: Jan. 13, 1999

[51] Int. Cl.[7] ..... C11D 7/50; C11D 7/30; B08B 3/08; C23G 5/028

[52] U.S. Cl. ..... 510/412; 510/169; 510/175; 510/273; 510/365; 134/40; 134/42

[58] Field of Search ..... 510/412, 169, 510/175, 273, 365; 134/40, 42; 570/137

[56] References Cited

U.S. PATENT DOCUMENTS

| | | | |
|---|---|---|---|
| 3,351,560 | 11/1967 | Brown et al. | 252/171 |
| 3,516,938 | 6/1970 | Zisman et al. | 252/171 |
| 4,193,838 | 3/1980 | Kelly et al. | 162/5 |
| 4,578,209 | 3/1986 | Hisamoto et al. | 252/143 |
| 5,207,953 | 5/1993 | Thorssen et al. | 252/601 |
| 5,851,977 | 12/1998 | Gorton et al. | 510/412 |

FOREIGN PATENT DOCUMENTS

| | | |
|---|---|---|
| 54-006882 | 1/1979 | Japan . |

*Primary Examiner*—Christine Skane
*Attorney, Agent, or Firm*—E. E. Spielman, Jr.

[57] ABSTRACT

A cleaning process suitable for both mild and aggressive applications employs non-flammable, non-corrosive and environmentally friendly, fluorinated hydrobromocarbon solvent based cleaning compositions.

17 Claims, No Drawings

FLUORINATED HYDROBROMOCARBON SOLVENT CLEANING PROCESS AND COMPOSITION

TECHNICAL FIELD

This invention relates generally to cleaning processes using hydrobromocarbon based cleaning solvent compositions and, more particularly, to a non-flammable, non-corrosive, and environmentally friendly cleaning solvent composition and cleaning process based on fluorine containing hydrobromocarbon compounds such as 3-bromo-1,1,1-trifluoropropane.

BACKGROUND OF THE INVENTION

The precision cleaning of parts to remove contaminants such as waxes, greases, oils and solder flux residues is an integral part of many manufacturing, maintenance, and refurbishing operations. Critically clean parts may be necessary for the next step in the manufacturing process or for satisfactory performance in their end-use application. Many of the solvents, such as 1,1,1-trichloroethane, previously used for these cleaning tasks have been banned or restricted because of toxicological or environmental concerns. Solvent cleaners based on n-propyl bromide meet most of the demands for a new solvent but can be either too aggressive towards some plastic and elastomeric components or not aggressive enough for other applications. For example, when cleaning cellulose triacetate polymer based photographic film in order to remove contaminants such as skin oils and dust, the n-propyl bromide causes film curling such that it must be used in combination with co-solvents. New solvents based on hydrofluorocarbons, hydrofluoroethers, and hydrochlorofluorocarbons are very expensive and are not very efficient as cleaning agents.

The addition of small amounts of no more than about 5% by volume of a fluorine and/or chlorine containing brominated hydrocarbon, such as dibromodifluoromethane, to a flammable organic solvent to provide a fire retardant solvent composition is disclosed in U.S. Pat. No. 5,207,953. A hot vapor stripping process for removing resin coatings from paperstock, which uses an acyclic hydrocarbon containing one to three carbons and two to eight bromine, chlorine or fluorine atoms, at least two of which are bromine or chlorine, is described in U.S. Pat. No. 4,193,838.

We have now found that certain fluorine containing hydrobromocarbon compounds are mild enough to be used neat in cleaning plastic and elastomeric substrates, such as cellulose triacetate polymer based movie film, and yet are effective cleaners for other applications which require a more aggressive cleaning action such as the removal of grease and solder residues from precision metal and electronic parts.

SUMMARY OF THE INVENTION

In accordance with this invention there is provided a process for cleaning the surface of an article, which process comprises contacting said surface with a cleaning solvent composition so as to remove contaminants from said surface, said cleaning solvent composition comprising:

(A) from about 85 to 100 weight percent of a cleaning solvent portion, at least 40 weight percent of said solvent portion being one or more fluorinated hydrobromocarbons having from 1 to 3 carbons, from 1 to 3 bromine atoms and at least one fluorine atom, and (B) from 0 to about 15 weight percent of one or more stabilizer compounds for said solvent portion.

Also provided is a cleaning solvent composition which comprises:

(A) from about 85 to 99.95 weight percent of a cleaning solvent portion, at least 40 weight percent of said solvent portion being one or more fluorinated hydrobromocarbons having from 1 to 3 carbons, from 1 to 3 bromine atoms and at least one fluorine atom, and (B) from about 0.05 to 15 weight percent of one or more stabilizer compounds for said cleaning solvent portion.

DETAILED DESCRIPTION

Suitable fluorinated hydrobromocarbon compounds for use as cleaning solvents in accordance with the invention have from 1 to 3 carbon atoms, from 1 to 3 bromine atoms and from 1 to 6 fluorine atoms. The compounds can also include one or two chlorine atoms. The halogen atoms can be attached at any position on the carbon chain. The compounds should be liquid at room temperature, preferably with a boiling range of from about 50 to 120° C., have no flash point, no major environmental or toxicology problems (e.g., mutagen, ozone depleter, carcinogen, etc.). They should also have hydrolytic and thermal stability and moderate to low odor. Non-limiting specific examples of suitable compounds include 3-bromo-1,1,1-trifluoropropane, 1,3-dibromo-1,1-difluoropropane, dibromofluoromethane, 1-bromo-3-fluoropropane, chlorodibromofluoromethane, fluorotribromomethane,1,2-dibromohexafluoropropane, 1,2-dibromo-1,1-difluoroethane, and 2-bromo-2-chloro-1,1,1-trifluoroethane. Mixtures of two or more of the above solvents can be used.

The solvents can either be used neat or in combination with up to about 60 weight percent of one or more co-solvents which have a solvent utility in combination with the fluorine containing hydrobromocarbons. The solvent utility concerns mainly solvating fats, waxes, resins, greases, oils and the like. When present, the co-solvents are preferably used in amounts of from about 10 to 50 weight percent of the solvent portion of the compositions. More preferably, the cleaning solvent compositions include at least about 75 weight percent of fluorinated hydrobromocarbon solvent(s).

Non-limiting examples of suitable co-solvents include halogenated hydrocarbons having from 1 to 10 carbons and 1 to 4 chlorine and/or bromine atoms such as n-propyl bromide, bromochloromethane, chlorodibromomethane, 1-bromo-2-chloroethane, 2-bromo-1-chloropropane, n-butyl bromide, isobutyl bromide, n-amyl bromide, alkyl bromide, hexylene bromide, bromodichloromethane, bromotrichloromethane, dibromoethylene, trans-1,2-dichloroethene, methylene chloride, and 2-bromo-1-chloropropane.

Also suitable as co-solvents are non-halogenated hydrocarbons which have a solvent utility in combination with the fluorine containing hydrobromocarbons. By the term "hydrocarbon" is meant a compound which contains mostly carbon and hydrogen but can also contain some oxygen, sulfur and/or nitrogen constituents. Generally, the co-solvent hydrocarbons can be found in the following classes: alkanes, alkenes, cycloalkanes, cycloalkenes, aromatics, alcohols, ketones, esters, ethers, amines and mineral oils and derivatives thereof Exemplary hydrocarbon solvents include hexane, benzene, toluene, cyclohexane, terpenes, such as pinene, limonene, carene and camphene, acetone, methanol, propanol, ethanol, isopropanol and methylethyl ketone.

Mixtures of any of the above co-solvents can be used. The co-solvents and amounts are selected so that the cleaning solvent composition has no flash or fire point by the standard Tag Open Cup (ASTM D-1310) or Tag Closed Cup (ASTM D-56) methods. The co-solvents are also selected to provide a miscible mixture. When the cleaning solvent is to be used in solvent degreasing, the co-solvents are preferably chosen to provide a cleaning solvent composition which forms either a constant boiling azeotrope or at least a solvent composition which will distill without any substantial change in composition for at least about 24 hours so that it can be recycled without any significant dilution or concentration of any of the components (i.e., an "azeotropic-like" mixture).

Depending upon the application and the presence of co-solvents, it may be desirable to include from about 0.05 to 15 weight percent, based on the total weight of cleaning solvent composition, of one or more stabilizer compounds, such as metal passivators and acid acceptors, for the cleaning solvent portion of the compositions in order to minimize the corrosive effects of any products which may form due to the dehydrohalogenation or hydrolysis of the solvent during the cleaning process. For example, when the solvents are used at elevated temperatures in contact with certain metals, such as aluminum, magnesium and titanium, the metals appear to catalyze the dehydrohalogenation of the solvent to produce halogen acid which is corrosive to metals. Hydrolysis with small amounts of water in contact with the solvent may also produce halogen acids. Non-limiting examples of suitable types of compounds for stabilizing the solvent compositions include ethers, nitroalkanes, epoxides, alcohols and amines.

Non-limiting examples of suitable ethers include 1,2-dimethoxyethane, 1,4-dioxane, 1,3-dioxolane, diethyl ether, diisopropyl ether, dibutyl ether, trioxane, alkyl cellosolves in which the alkyl group has 1 to 10 carbon atoms such as methyl cellosolve, ethyl cellosolve and isopropyl cellosolve, dimethyl acetal, γ-butyrolactone, methyl t-butyl ether, tetrahydrofuran and N-methylpyrrole. They are usable either singularly or in the form of a mixture of two or more of them.

Non-limiting examples of suitable epoxides and alcohols include the epoxides epichlorohydrin, propylene oxide, butylene oxide, cyclohexene oxide, glycidyl methyl ether, glycidyl methacrylate, pentene oxide, cyclopentene oxide and cyclohexene oxide and the alcohols isopropanol, propanol, butanol and sec-butanol. They are usable either singularly or in the form of a mixture of two or more of them.

Non-limiting examples of nitroalkanes usable in the present invention include nitromethane, nitroethane, 1-nitropropane, 2-nitropropane and nitrobenzene. They are usable either singularly or in the form of a mixture of two or more of them.

Non-limiting examples of suitable amines include hexylamine, octylamine, 2-ethylhexylamine, dodecylamine, ethylbutylamine, hexylmethylamine, butyloctylamine, dibutylamine, octadecylmethylamine, triethylamine, tributylamine, diethyloctylamine, tetradecyldimethylamine, diisobutylamine, diisopropylamine, pentylamine, N-methylmorpholine, isopropylamine, cyclohexylamine, butylamine, isobutylamine, dipropylamine, 2,2,2,6-tetramethylpiperidine, N,N-di-allyl-p-phenylenediamine, diallylamine, aniline, ethylenediamine, propylenediamine, diethylenetriamine, tetraethylenepentamine, benzylamine, dibenzylamine, diphenylamine and diethylhydroxyamine. They are usable either singularly or in the form of a mixture of two or more of them.

When present, preferred amounts of each type of stabilizer compound include from about 0.05 to about 1.0 wt. % epoxide, from about 0.05 to about 1.0 wt. % alcohol, from about 0.5 to about 4.0 wt. % ether, from about 0.05 to about 1.0 wt. % nitroalkane and from about 0.05 to about 1.0 wt. % amine, with each of the above percentages being based on the total weight of solvent cleaning composition.

The cleaning processes of this invention include cold cleaning applications, such as cleaning plastic or elastomeric substrates, for example movie film, as well as hot cleaning processes such as the vapor cleaning of electronic parts, such as circuit boards, using a vapor degreaser. Cold cleaning is usually characterized by the immersion of the article to be cleaned in the solvent composition at a temperature which is within the range of from about room temperature (i.e., 20°–30° C.) to about 50° C. The process of the invention will clean cellulose triacetate polymer based movie film without curling or other damage. The process is also useful in aggressive cleaning applications such as the vapor cleaning of electronic parts at elevated temperatures. Vapor cleaning is characterized by passing the article to be cleaned through a vapor layer above the boiling solvent compostion, with the article at a temperature which causes condensation of the vapor on its surfaces. The condensate effects its cleaning function and then drips off. The vapor temperatures are generally approximate to the boiling point of the solvent composition, (from about 50 to 120° C.), depending upon the composition of particular solvent composition being used. The cleaning processes can also be accompanied by agitation such as mechanical stirring or ultrasonic agitation.

A typical vapor degreaser system has a boil-up sump which contains the cleaning solvent composition and an adjacent rinse sump which collects the condensed solvent vapor. The solvent in the rinse sump overflows back into the boil-up sump. Solvent vapor fills the chamber above the two sumps. The hot vapors condense onto the part to be cleaned. Optionally, a spray wand is used to place additional hot solvent onto the part when the part has reached the vapor temperature. Besides placing the part into the vapor, it can also be immersed into the boil-up sump and/or the rinse sump to further enhance cleaning. In addition, the rinse sump may also be equipped with an ultrasonic agitator which further enhances the cleaning efficiency. As discussed above, in order to maintain a consistant composition in each part of the vapor degreaser system, the cleaning solvent composition is preferably azeotropic or azeotropic-like.

The invention is further illustrated by, but is not intended to be limited to, the following examples. The fluorinated hydrobromocarbons used in the examples are all known compounds and are available, for example, from Aldrich Chemicals.

EXAMPLE 1

Individually, five samples of cellulose triacetate polymer based color negative camera film from Eastman Kodak Company are each immersed in a bath containing one of the fluorinated hydrobromocarbon solvents listed below for 10 minutes at room temperature. The samples are then removed and allowed to dry for 1 hour. The film samples are then compared to the following controls: 1,1,1-trichloroethane (no damage to film), n-propyl bromide (moderate curling damage to film) and acetone (heavy damage to film). In the case of all of the five test solvents listed below, no damage to the film is observed. The results are indicative of the successful use of the process of the invention in "soft" solvent cleaning applications where skin oils, dust and other matter, which can be deposited on movie film during processing and handling, are removed from the film surface.

Cleaning Solvent:

3-bromo-1,1,1-trifluoropropane (b.p.=63.5° C.)[CAS# 460-32-2]

1,3-dibromo-1,1-difluoropropane (b.p.=62° C.)[CAS# 460-25-3]

dibromofluoromethane (b.p. 65° C.)[CAS# 1868-53-7]

1-bromo-3-fluoropropane [CAS# 352-91-0]

chlorodibromofluoromethane [CAS# 353-55-9].

EXAMPLE 2

Two cleaning solvents are compared, n-propyl bromide (nPB) and 3-bromo-1,1,1-trifluoropropane (BTFP). The solvents are compared for cleaning efficiency on baked-on soils. Two soils are used, a mineral oil and a polyol ester. All procedures are run in triplicate and the results are averaged. The soils are smeared on weighed C1010 steel coupons and then baked in an oven at 200° C. for one hour. The coupons are again weighed to determine the amount of soil remaining after the bake-on period. Each coupon is then cleaned by total immersion in the boiling test solvent for three minutes. The coupons are allowed to cool and air dry before being re-weighed. The results are summarized in Table 1.

TABLE 1

| | Comparison of Cleaning Efficiciency (Weight Percent of Soil Removed) | | |
|---|---|---|---|
| | Soil | nPB | BTFP |
| 2a. | Mineral Oil | 99.62 | 99.06 |
| 2b. | Polyol Ester | 56.00 | 3.97 |

The results reported in Table 1 indicate that either solvent is capable of removing the baked-on mineral oil. The polyol ester, on the other hand, is much more difficult to clean from the coupon. The more aggressive cleaning action of the prior art n-propyl bromide vs. that of the 3-bromo-1,1,1-trifluoropropane is clearly demonstrated in this procedure.

EXAMPLE 3

In order to clean electronic parts such as lead frames or printed circuit boards to remove solder, flux or other residues, a hot vapor process is employed. The fluorinated hydrobromocarbon solvent, such as 3-bromo-1,1,1-trifluoropropane is placed in the boil up sump of a vapor degreaser and heated to boiling (63.5° C.). The parts to be cleaned are placed in a basket which is lowered into the vapor zone of the degreaser for typically from about 0.5 to 5 minutes and then the basket may be immersed in the boiling solvent in the sump for 0.5 to 5 minutes. The basket is then transferred to the rinse sump which contains condensed solvent for 0.5 to 5 minutes and removed back to the vapor zone for 0.5 to 5 minutes until dry. The cleaned parts are then cooled in air.

As demonstrated in Example 1, surprisingly, by using a brominated cleaning solvent which contains at least one fluorine atom, such as 1-bromo-3-fluoropropane the process and compositions of the invention permit "soft" substances such as movie film to be cleaned without damage as compared to the use of the non-fluorinated counterpart, n-propyl bromide, which causes film curling. The milder cleaning action of the fluorinated, brominated solvents of the invention, such as 3-bromo-1,1,1-trifluoropropane, compared to n-propyl bromide is also demonstrated by Example 2b. However, such milder solvents are still effective in removing many soils from metals as shown by Example 2a. Therefore, a more versatile cleaning process results from the use of the fluorinated solvents as they can be used without the need for co-solvents in both the cold cleaning of plastic substances and in more aggressive cleaning applications such as the hot vapor cleaning of metal and electronic parts which may contain plastics or elastomers that are damaged by more aggressive cleaning solvents such as n-propyl bromide.

What is claimed is:

1. A process for cleaning the surface of an article, which process comprises contacting said surface with a cleaning solvent composition so as to remove contaminants from said surface, said cleaning solvent composition comprising:

(A) from about 85 to 99.95 weight percent of a cleaning solvent portion, at least 75 weight percent of said solvent portion being one or more fluorinated hydrobromocarbons selected from the group consisting of 3-bromo-1,1,1-trifluoropropane, 1,3-dibromo-1,1-difluoropropane, chlorodibromofluoromethane, 1,2-dibromo-1,1-difluoroethane, and 2-bromo-2-chloro-1,1,1-trifluoroethane, and (B) from 0.05 to about 1 weight percent of one or more stabilizer compounds for said cleaning solvent portion.

2. The process according to claim 1 wherein the cleaning solvent portion consists essentially of one or more fluorinated hydrobromocarbons.

3. The process according to claim 1 wherein said cleaning solvent composition consists essentially of one or more fluorinated hydrobromocarbons and one or more stabilizer compounds for said fluorinated hydrobromocarbons.

4. The process according to claim 1 wherein said process is carried out at a temperature of less than about 50° C.

5. The process according to claim 1 wherein said process is carried out at a temperature of from about 50° C. to about 120° C.

6. The process according to claim 1 wherein said process is carried out in a vapor degreaser in which said cleaning solvent composition is boiled to provide a vapor layer of said solvent compostion in contact with said surface.

7. The process according to claim 1 wherein said fluorinated hydrobromocarbon is 3-bromo-1,1,1-trifluoropropane.

8. A cleaning solvent composition which comprises:

(A) from about 85 to 99.95 weight percent of a cleaning solvent portion, at least 75 weight percent of said solvent portion being one or more fluorinated hydrobromocarbons selected from the group consisting of 3-bromo-1,1,1-trifluoropropane, 1,3-dibromo-1,1-difluoropropane, chlorodibromofluoromethane, 1,2-dibromo-1,1-difluoroethane, and 2-bromo-2-chloro-1,1,1-trifluoroethane, and (B) from about 0.05 to 15 weight percent of one or more stabilizer compounds for said cleaning solvent portion.

9. The solvent compostion of claim 8 wherein said cleaning solvent portion consists essentially of one or more fluorinated hydrobromocarbons.

10. The composition according to claim 8 wherein said fluorinated hydrobromocarbon is 3-bromo-1,1,1-trifluoropropane.

11. The composition according to claim 8 wherein said composition includes an ether stabilizer.

12. The composition according to claim 9 wherein said composition includes an ether stabilizer.

13. The composition according to claim 8 wherein said solvent portion includes from about 10 to 25 weight percent of a co-solvent.

14. A process for cleaning the surface of an article, which process comprises contacting said surface with a cleaning solvent composition so as to remove contaminants from said surface, said cleaning solvent composition comprising:

(A) from about 85 to 100 weight percent of a cleaning solvent portion, at least 40 weight percent of said solvent portion being 3-bromo-1,1,1-trifluoropropane, and (B) from 0 to about 15 weight percent of one or more stabilizer compounds for said cleaning solvent portion.

15. The process according to claim 14 wherein said cleaning solvent composition includes from about 0.05 to 15 weight percent of one or more stabilizer compounds for the solvent portion of said cleaning solvent composition.

16. A cleaning solvent composition which comprises:

(A) from about 85 to 99.95 weight percent of a cleaning solvent portion, at least 40 weight percent of said solvent portion being 3-bromo-1,1,1-trifluoropropane, and (B) from about 0.05 to 15 weight percent of one or more stabilizer compounds for said cleaning solvent portion.

17. The solvent composition of claim 16 wherein said cleaning solvent portion consists essentially of 3-bromo-1,1,1-trifluoropropane.

* * * * *

UNITED STATES PATENT AND TRADEMARK OFFICE

CERTIFICATE OF CORRECTION

PATENT NO. : 6,133,221
DATED : October 17, 2000
INVENTOR(S) : Phillip R. Beaver; James E. Boone; Dixie E. Goins; Eric W. Liimatta; David L. Shelton; Ronald L. Shubkin It is certified that error appears in the above-identified patent and that said Letters Patent is hereby corrected as shown below:

Column 6,
Line 22, reads "... about 1 weight percent ..." and should read
-- ... about 15 weight percent ... --.

Signed and Sealed this

Fifteenth Day of January, 2002

*Attest:*

*Attesting Officer*

JAMES E. ROGAN
*Director of the United States Patent and Trademark Office*